US005603419A

United States Patent [19]

Peterson

[11] Patent Number: 5,603,419

[45] Date of Patent: Feb. 18, 1997

[54] SHIPPING RACK

[76] Inventor: Thomas W. Peterson, 402 Old Chester Rd., Winnsboro, S.C. 29180

[21] Appl. No.: 498,324

[22] Filed: Jul. 5, 1995

[51] Int. Cl.[6] ..... A47F 5/00

[52] U.S. Cl. ..... 211/195; 211/59.4; 248/316.5; 410/43

[58] Field of Search ..... 211/195, 41, 59.4, 211/150; 410/39, 43; 248/316.5

[56] References Cited

U.S. PATENT DOCUMENTS

| | | | |
|---|---|---|---|
| 2,067,763 | 1/1937 | Holan | 410/2 |
| 2,432,974 | 12/1947 | Stevens et al. | 410/2 |
| 3,580,606 | 5/1971 | Wagner | 410/43 |
| 3,595,176 | 7/1971 | Broling | 410/33 |
| 3,680,518 | 8/1972 | Tabuchi et al. | 211/59.4 X |
| 3,744,647 | 7/1973 | Jelinek | 410/43 |
| 3,857,494 | 12/1974 | Giardini | 211/194 |
| 4,498,822 | 2/1985 | Diba | 410/2 |
| 4,572,382 | 2/1986 | Niederprum | 211/150 |
| 4,712,691 | 2/1987 | Grill et al. | 211/150 X |
| 4,733,781 | 3/1988 | Gerlach | 410/43 |
| 4,919,277 | 4/1990 | Jeruzal | 410/41 |
| 5,086,920 | 2/1992 | Binienda | 206/335 |
| 5,378,093 | 1/1995 | Schroeder | 410/32 |
| 5,439,152 | 8/1995 | Campbell | 211/195 X |

*Primary Examiner*—Robert W. Gibson, Jr.
*Attorney, Agent, or Firm*—Michael A. Mann, P.A.

[57] ABSTRACT

A rack for shipping a set of objects such as vehicle hoods comprises a base, two folding sides, a folding bumper, and several sets of pivotable clamps attached to the sides. The rack is employed by unfolding the sides to the upstanding, spaced-apart position, and loading the objects one at a time onto a set of clamps pivoted to the operative position from a storage position. As each object is put in position, the next set of clamps is pivoted into the operative position and loaded with the next object. The clamps are tightened and loosened by turning a bolt on each one with an air wrench. Pivotable clamps enable closer nesting of the objects. The bumper separates adjacent racks so the objects held by them do not interfere.

20 Claims, 4 Drawing Sheets

SHIPPING RACK

BACKGROUND OF THE INVENTION

1. Field of the Invention:

The present invention relates to storage and shipping racks. In particular, the present invention relates to racks for shipping large or bulky objects such as parts for vehicles.

2. Discussion of Background:

Manufacturing complex pieces of equipment such as vehicles is not always done from start to finish at a single manufacturing facility. Many of the components of vehicles are subcontracted out to other manufacturers (a practice called "out-sourcing"), who make the parts at their own facilities, or are subcontracted out to subsidiaries at other locations. The components made at these other locations must then be shipped to an assembly plant where the final product is assembled from its component parts.

In manufacturing cars and trucks, for example, body parts such as hoods, fenders, cabs, cab roofs, sleeper roofs, side panels and farings are frequently made at one location and shipped to the assembly plant at a rate that matches production requirements. These components may be made of sheet metal or fiberglass and are, therefore, subject to damage in shipping if they are bent, scratched or cracked. To avoid damage, they must be carefully packed and unpacked and secured during shipping. Their bulky shape makes them challenging to package properly.

In the past, bulky components were shipped on pallets made of wood. The components would be secured to the pallets by metal bands. The used pallets were simply thrown away. However, more recently the cost of disposal of all types of wastes, including wood, has become prohibitive, and now pallets are often returned and reused. Because wooden pallets are not very durable, there has been a growing interest in more permanent devices for packing bulky components for shipment.

Ideally, such a device would be durable and strong; it would hold a number of similar components at one time; it would fit within the deck space of a standard van or flatbed; and it would hold the parts securely, but permit the removal of each part without undue effort. Thus, there remains a need for a device for shipping bulky components.

SUMMARY OF THE INVENTION

Briefly and broadly stated, the present invention is a rack for holding a plurality of like objects in a closely-packed array during shipping. The rack comprises a frame and a set of clamps pivotally attached to the frame. Each set of clamps holds one object in an orientation that enables other objects to be held close to it. Each clamp opens and closes on the object it holds by turning a clamp bolt, preferably with an air wrench, between a clamped position and a released position. The clamps pivot between an operative position, where they are in the correct position for receiving the objects, and a storage position, where they are pivoted out of the way for removal of adjacent objects.

The frame has a base and two sides. Preferably, the base has a pivoting or sliding bumper that spaces that rack apart from the next rack so components from the first rack do not interfere with those on the next rack. The sides fold from a storage position against the base to an operative position where they can hold the array of objects. The sides and the base are secured in the operative positions by locks and, in the storage position, are formed in such a way that one rack can be stacked easily on another.

The clamp is an important feature of the present invention. The basic design of the clamp, with variations for specific applications, can be used to secure a large number of objects in a small volume, and to secure them properly to avoid damage caused by other objects, the rack, or the clamp itself. The object rests on the clamp whether the clamp is in the clamped or released position, so loosening the bolt will not cause the object to spring out of the rack or fall. The clamps can be quickly tightened and quickly released using a simple air wrench, and all the clamps on one rack can be tightened or released at one time because each object rests on its clamps. Pivoting the clamps out of the way makes it easier to load and unload the rack and also makes it possible to store the objects closer together.

The folding sides of the rack are another important feature of the present invention. This enables a rack to be folded to a fraction of its operational size and to be stacked, so that one truck can return as many folded, empty racks to a manufacturer as perhaps four trucks carried when unfolded and laden with objects.

The combination of the frame and the clamps is an important feature of the present invention because the frame holds the clamps securely in the desired position with respect to the objects. In doing so, the frame serves as the primary source of the strength to protect the objects and keep them aligned. Moreover, the clamps are located on the frame so as to stiffen the object to protect it, both from wobbling in transit and from damage by adjacent objects.

Other features and their advantages will be apparent to those skilled in the art of shipping bulky objects from a careful reading of the Detailed Description of Preferred Embodiments accompanied by the following Drawings.

DETAILED DESCRIPTION OF PREFERRED EMBODIMENTS

Figure 1:
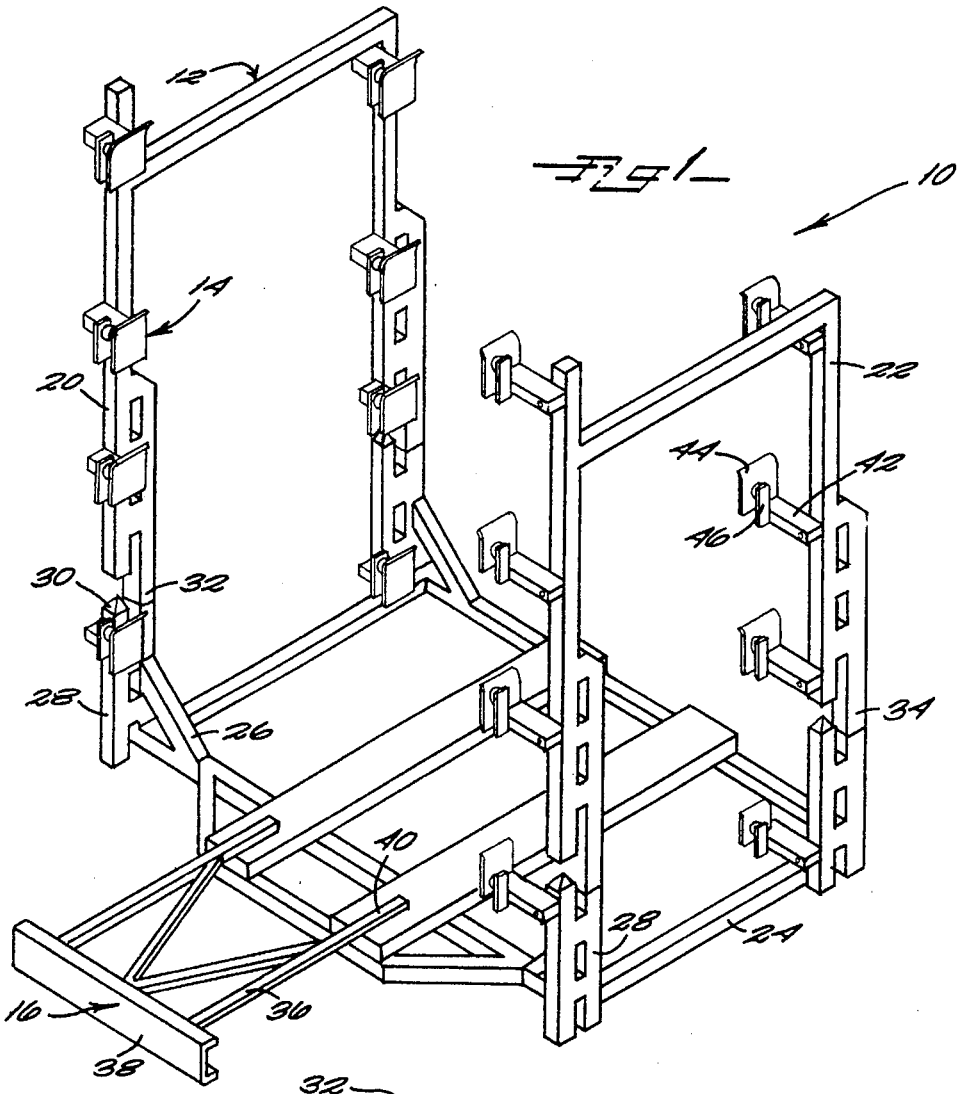
FIG. 1 is a perspective view of a shipping rack in the operative position according to a preferred embodiment of the present invention.

The present invention is a rack for shipping objects. The word "object" will be used to describe that which is held by the present rack, but the object is not part of the present invention. It must be understood that this rack is best suited for objects having certain characteristics. Namely, an object herein is one that is made of sheet metal, fiberglass, plastic, glass, wood, or composite material that is shaped so that the volume of space it occupies, as defined by its greatest measurements in three dimensions, is large compared to the thickness of the material. Because of its shape, objects can often be "nested"; that is, there will be one or more orientations of two objects that will enable them to be placed close enough to the other so that one will be partly within the space, again defined by the other's greatest measurements in three dimensions, occupied by a second object without the two touching each other.

For some objects, there will be a "class A" side which means a side that has been processed to give it a more finished look. For example, the class A side may be polished or painted or molded so that it is smoother. Typical objects include fenders, quarter panels, hoods, roofs, trunk lids, farings, cabs, and wind shields, guards, and engine housings. For these types of objects, the outside or side seen by the user of the finished product is the class A side.

In configuring a rack according to the present invention, the component is first examined in an unrestrained condition so that it is not confined, its dimensions are true, and its various surfaces are in true alignment. Its dimensions are measured and areas of its structure that are weaker or prone to move during shipping are identified. These areas would include broad expanses or thinner or narrower portions. Also, there will be areas that are better suited, and others that are less well suited, for attachment of a clamp. The clamp will secure the component near its edge. Along the edge, at any locations suitable for attaching a clamp, those specific locations where the attachment of a clamp would reinforce or add stiffness to weak areas are preferred locations for clamping.

The geometry of the object is examined to determine in what orientation the object will nest best and how closely objects can be spaced. Objects will be placed on a rack and removed from the rack either from the "front," which is a designated side, or from the top, or from a combination of the front and top.

The goal of clamping is simply to hold the part securely and without damage to the part's surface so that it will not come loose and it will not vibrate unacceptably when loaded in a rack and on a moving van or rail car. However, there are other requirements to be met. If a manufacturer needs twelve parts per week, the rack should hold twelve, six, four, three or two so that one, two, three, four or six racks are needed, respectively, rather than some odd combination that results in partially empty racks. Preferably, each rack would fit within a standard van. A standard van is typically 40 to 53 feet long, eight and one half feet wide, and 107 inches high. If the twelve parts needed by the manufacturer, in the present example, can be made to fit in three racks that would fit within a standard van, but could also be made to fit in two oversized racks, the choice clearly favors the former.

Figure 2:
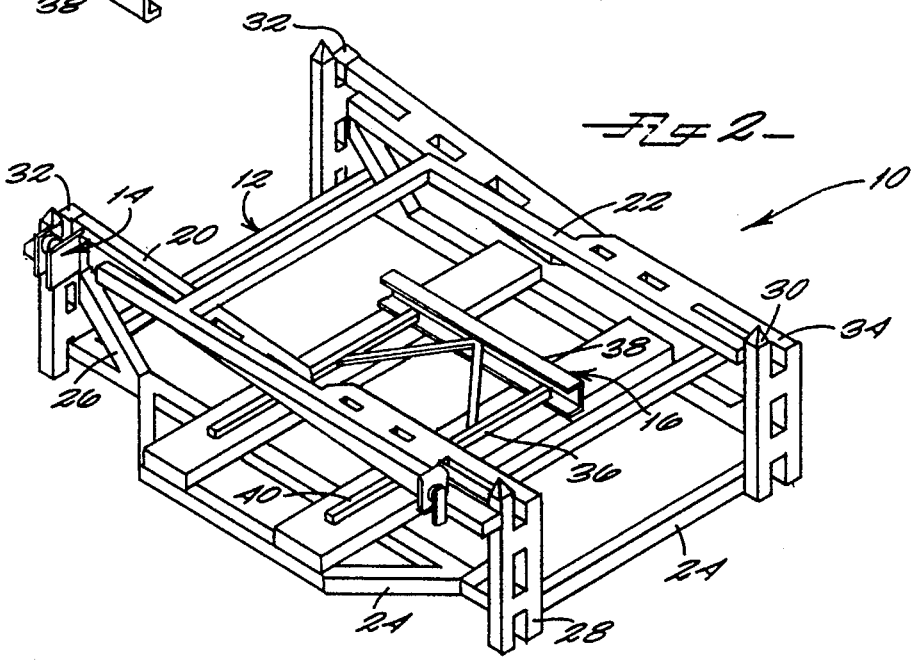
FIG. 2 is a perspective view of a shipping rack in the stored position according to a preferred embodiment of the present invention.

Referring now to FIGS. 1 and 2, there is illustrated a rack according to one preferred embodiment of the present invention. The rack is indicated generally by the reference numeral 10. The principals that will be described with respect to rack 10 apply generally to other racks made according to the present invention; however, the details of construction, such as size, number of clamps, and specific relation of the parts of the rack will, of course, vary as the object to be shipped varies.

Rack 10 comprises a frame 12 that holds a plurality of clamps 14 in spaced relation to each other and a pivoting bumper 16. Frame 12 further comprises a first side 20 and a second side 22 that are supported by a base 24. First side 20 and second side 22 are pivotally attached to base 24, and have a first side pivot 32 and a second side pivot 34, respectively, so that both first side 20 and second side 22 can pivot between an operative position, as shown in FIG. 1, and a storage position, as shown in FIG. 2, where they are folded together over base 24. When in the operative position, first and second sides 20, 22, are upstanding, spaced apart and oppose each other, as shown in FIG. 1. When first and second sides 20, 22, are folded, posts 28 carried by base 24 define the greatest vertical dimension of rack 10. The tops of posts have points 30 to receive another rack stacked on top of rack 10. Therefore, when a shipment of objects has been completed, rack 10 can be folded and stacked on top of another rack and a third, fourth and fifth rack stacked on top of the second, so that as many as five folded racks can occupy the space of one unfolded rack.

In its unfolded, operative configuration, rack 10 holds several sets of clamps 14 in spaced relation to each other clamp 14 in the set and to each other set of clamps 14. Each clamp 14 in a set of clamps 14 cooperates with each other clamp 14 in that set to hold one object. Typically at least two clamps 14 will comprise a set and, for a vehicle hood, preferably a total of four clamps 14 per set, two on first side 20 and two on second side 22.

Each set of clamps 14 is preferably spaced apart from each other set just enough so that there is no interference between objects when clamped into position. As will be explained in more detail below, objects may be, and preferably are, nested so that fewer racks are needed to move a given number of objects than otherwise. Nesting is generally easier to achieve because the present clamps 14 can be pivoted out of the way when not in use. Therefore, only those clamps 14 holding or about to receive an object need to be in the operative position; others can be pivoted to the stored position.

Bumper 16 further comprises a bumper frame 36 and bumper bar 38. Bumper 16 pivots about a pivot point 40 at the end of bumper frame 36 between an operative position where bumper 16 is extended and a storage position where bumper 16 is pivoted back over base 24 of frame 12.

The purpose of bumper 16 is to separate one rack from the next so that there is enough space for objects clamped onto rack 10. Bumper 16 is placed into engagement with adjacent racks 10 and defines a separation distance between the adjacent rack and rack 10. When rack 10 is loaded with objects, the objects will extend beyond the actual space defined by first and second sides 20, 22, respectively. Bumper 16 protects the part of the objects that extends beyond sides 20, 22. Additionally, by using a pivoting foldable bumper, the overall dimensions of rack 10 in the folded and the unfolded configurations is reduced from that of a rack that would completely enclose the objects held by the clamps. Thus, bumper 16 saves material costs and saves shipping space on the back haul.

First and second sides 20, 22, and bumper 16 are preferably secured in the operative (unfolded) and storage (folded) configurations by means well known in the art, such as cauter pins or latches. Preferably, first and second sides 20, 22, are secured using square rings, as will be more fully described below.

Figure 3:
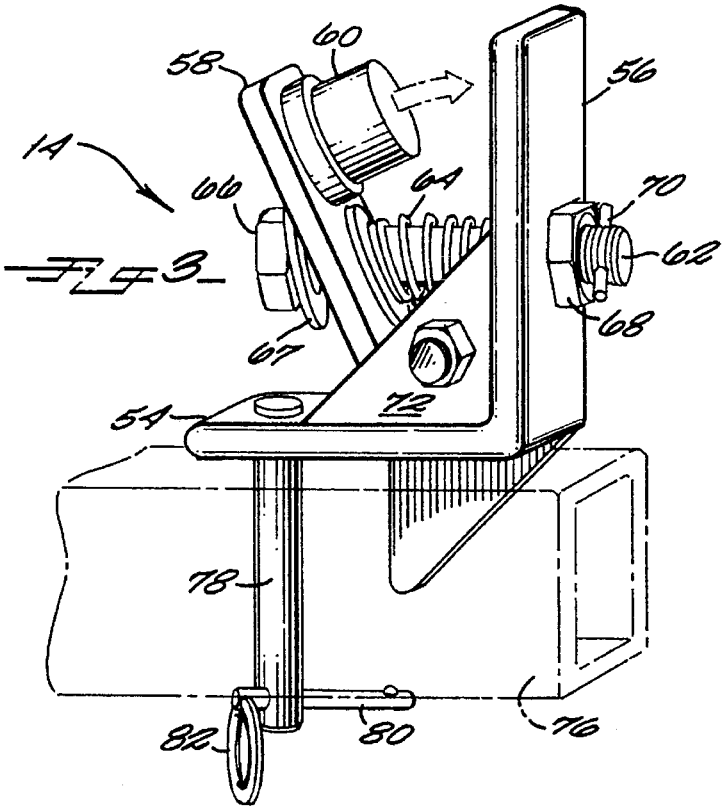
FIG. 3 is perspective view of a clamp according to a preferred embodiment of the present invention.
Figure 4:
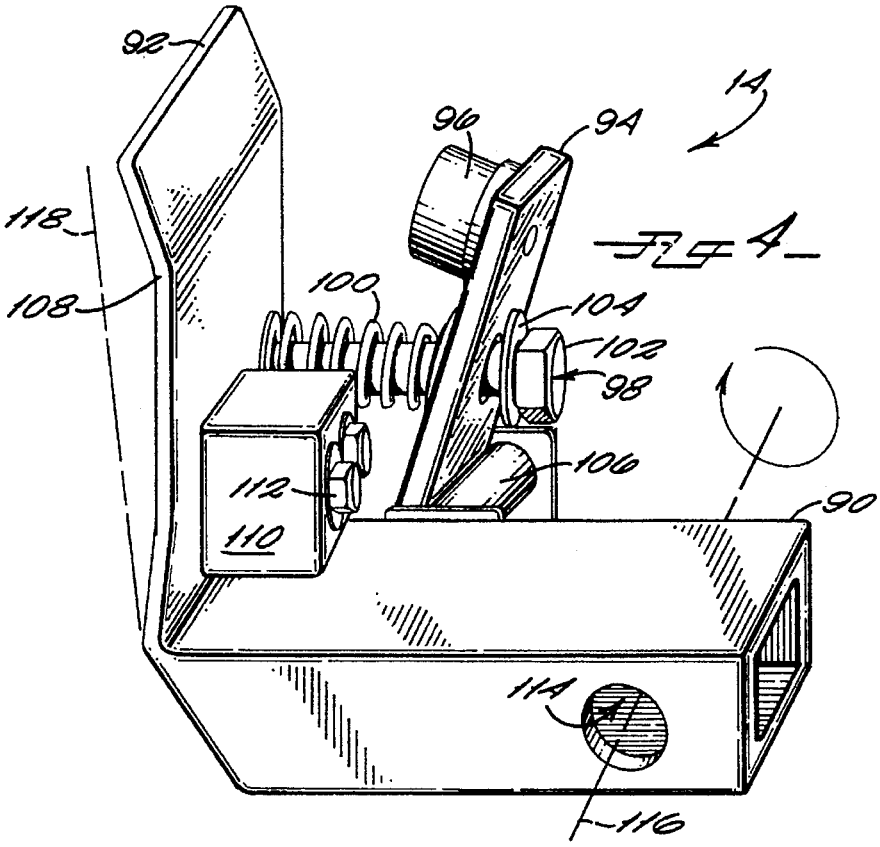
FIG. 4 is a perspective view of a clamp according to an alternative embodiment of the present invention.
Figure 5:
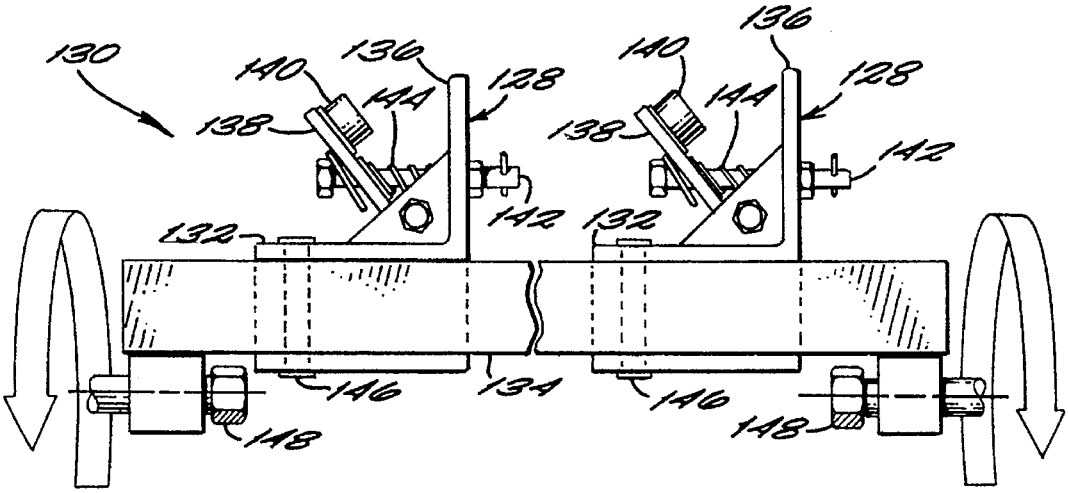
FIG. 5 is an elevational view of a clamp set according to a preferred embodiment of the present invention.

FIGS. 3, 4, and 5 illustrate several varieties of clamps 14. In FIG. 3, clamp 14 has a clamp base 54, a back plate 56, a pivoting flapper plate 58, and a rubber pad 60. A threaded bolt 62 runs through flapper plate 58 with a washer 67 on each side, through back plate 56 and is received into a nut 68. A bolt spring 64 compresses when flapper plate 58 is moved toward back plate 56. By turning bolt head 66, flapper plate 58 is moved between a released position away from back plate 56 and a clamped position toward back plate 56. Back plate 56 and clamp base 54 are connected by a support 72 for added stiffness.

To prevent bolt 62 from backing out of nut 68, a bolt stop 70 is provided. Bolt stop 70 is a small bar or spring pin inserted in a hole formed transverse to the axis of bolt 62. Bolt head 66 can easily be turned using an air wrench with the appropriate socket. Nut 68 limits the movement of bolt 62 when turning bolt head 66 in the counterclockwise direction to release an object. Limiting the movement in the clockwise direction is the engagement of pad 60 against the class A side of an object, as well as the maximum compression of bolt spring 64, with back plate 56 against the opposing side of the object.

In the embodiment of clamp 14 shown in FIG. 3, clamp base 54 is pivotally secured to a frame member 76 by a pivot pin 78 (or a bolt) running from base 54 through a hole in frame member 76. Pivot pin 78 is in turn kept in place by a ball detent pin 80. A ring pull 82 facilitates removal of pin 80 and thus the removal of clamp 14 from frame member 76.

To limit rotation of clamp 14 to the range of motion between its operative position and a storage position, a brace 74 stops motion about one axis when its side engages frame member 76, as shown, and when rotated so that its edge engages frame member 76.

This type of clamp 14 is suited for a rack where the clamps may need to be repositioned from one part of the rack to another in order to accommodate a type of object that comes in different lengths. The frame may have a row of holes from which to select the appropriate one for the size of the particular object being clamped. Then the clamp is moved to the selected hole, its pivot pin 78 is inserted in that hole of frame member 76, and secured in place with detent pin 80.

FIG. 4 illustrates a slightly different style of clamp 14. As with the clamp shown in FIG. 3, clamp 14 has a clamp base 90, a back plate 92, a flapper plate 94 that carries a rubber pad 96. A threaded bolt 98 operates against a bolt spring 100 to move flapper plate 94 between a clamped position where flapper plate 94 is moved toward back plate 92, and a released position where flapper plate 94 is moved away from back plate 92. Turning bolt 98 by bolt head 102 against washer 104 pivots flapper plate 94 about a pivot 106 toward and away from back plate 92.

Back plate 92 is curved at 108 so that, as an object is lowered into position on clamp 14, the curved portion of back plate helps to guide it into position. Also, back plate 92 and flapper plate 94 are offset with respect to the major axis of base 90 by a small distance 118. This type of clamp 14, with an offset, is preferred where the object should be gripped by clamp 14 at a location slightly offset from the point of pivotal attachment of clamp 14 to frame 12. Additionally, back plate 92 need not be perpendicular to base 90 of the shape of the object requires a different angle.

Clamp 14, as illustrated in FIG. 4, also has a rest 110, which is preferably a small plastic block on which the edge of an object rests, whether or not clamp 14 is in the clamped or the release position. Rest 110 is preferably made of fiberglass or some other material that will not mar the edge of the object. Rest is preferably fastened by one or more bolts 112. Some objects may have internal structures that can rest on the top edge of back plate. Clamps supporting these types of objects need not come equipped with additional rests.

A hole 114 in clamp base 90 fits onto a pin attached to frame 12 to enable clamp 14 to pivot about a pivot axis 116 from the operative position to the storage position.

FIG. 5 illustrates yet another preferred embodiment of the present invention. Where two or more clamps 128 can be rotated at the same time and about the same axis, they can be ganged in a clamp system 130. Each clamp 128 has a base 132 attached to a member 134, a backing plate 136 and a flapper plate 138. Flapper plate 138 has a pad 140 to engage the class A side of the object to be shipped. A bolt 142 is turned against the urging of a compression spring 144 to move flapper plate 138 toward backing plate 136. Clamps 128 may be pivotally attached to member 134 using a clamp pivot pin 146 or may be oriented and attached to receive the object without pivoting. Member 134 pivots on its own pivot pins 148 in the direct shown by the arrows, pivoting both clamps 128 with it. This embodiment is preferred when two or more clamps 128 are aligned with the same edge of an object and can be rotated out of the way at the same time.

Figure 6:
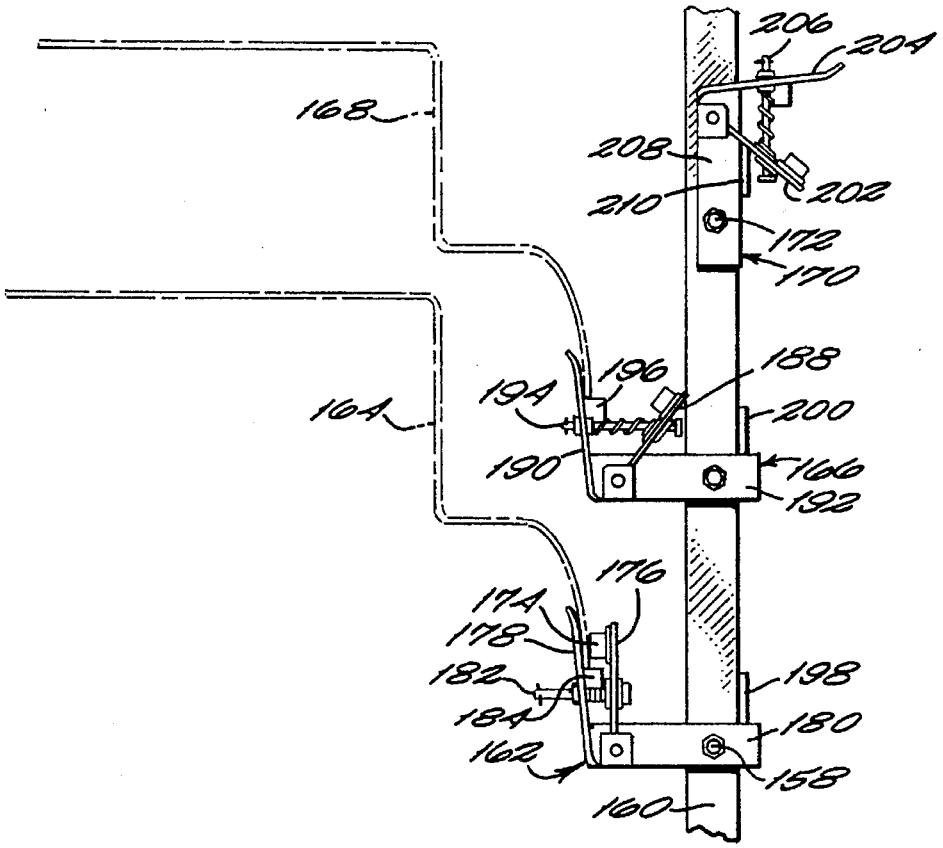
FIG. 6 is a detailed side view of a shipping rack according to a preferred embodiment of the present invention.

FIG. 6 illustrates a portion of a frame 160 to which objects are clamped. Pivotally carried by frame 160 is a first clamp 162 that rotates about a pivot pin 158 to the operative position and that holds a first object 164 in the clamped position. A second clamp 166 holds a second object 168 in the released position. A third clamp 170 has been pivotally rotated to the storage position about pivot pin 172.

The class A side of first object 164 is engaged by pad 174 of first clamp 162 which is secured to a flapper plate 176 that has been moved into engagement with a backing plate 178 in its pivotal attachment to a base 180 by turning a bolt 182. First object 164 rests on a rest 184.

Second clamp 166 is shown in the release position, as flapper plate 188 is seen to be away from a backing plate 190. Both are attached to a base 192 in the operative position, bolt 194 having been turned to its extreme position. Although second object 168 has been released by second clamp 166, it remains at rest on a rest 196 until lifted.

In the case of both first and second clamps, 162, 166, the top side of bases 180 and 192, respectively, engage the bottom edge of stops 198 and 200, respectively.

Third clamp 170 is in the released position, its flapper plate 202 moved apart from its backing plate 204 by turning bolt 206, and its base 208 rotated about pivot pin 172 to the storage position so that second object 168 can be removed. The top edge of base 208 rests against a stop 210. Stops 198, 200 and 210 are used to limit the rotation of clamps 162, 166, 170 to the range of motion of movement between operative and storage positions.

Note that first object 164 extends upwards into the space defined by the maximum dimensions of second object 168. If second clamp 166 and third clamp 170 could not be rotated, additional clearance would be required to assure that an object would not be marred in removing it from rack 160. Thus, pivotable clamps make it possible to haul more objects in less space than otherwise. The value of this can be illustrated in the case of a manufacturing operation that needs 18 objects for assembly each week. If a rack without pivoting clamps could hold four objects rather than six with pivoting clamps, and if a van can hold three racks, then two vans would be needed to deliver the 18 objects on racks without pivoting clamps. With pivoting clamps, only one van is needed to deliver all 18. Furthermore, two fewer racks are needed for delivering the weekly requirement of objects if the racks have rotatable clamps.

Figure 8:
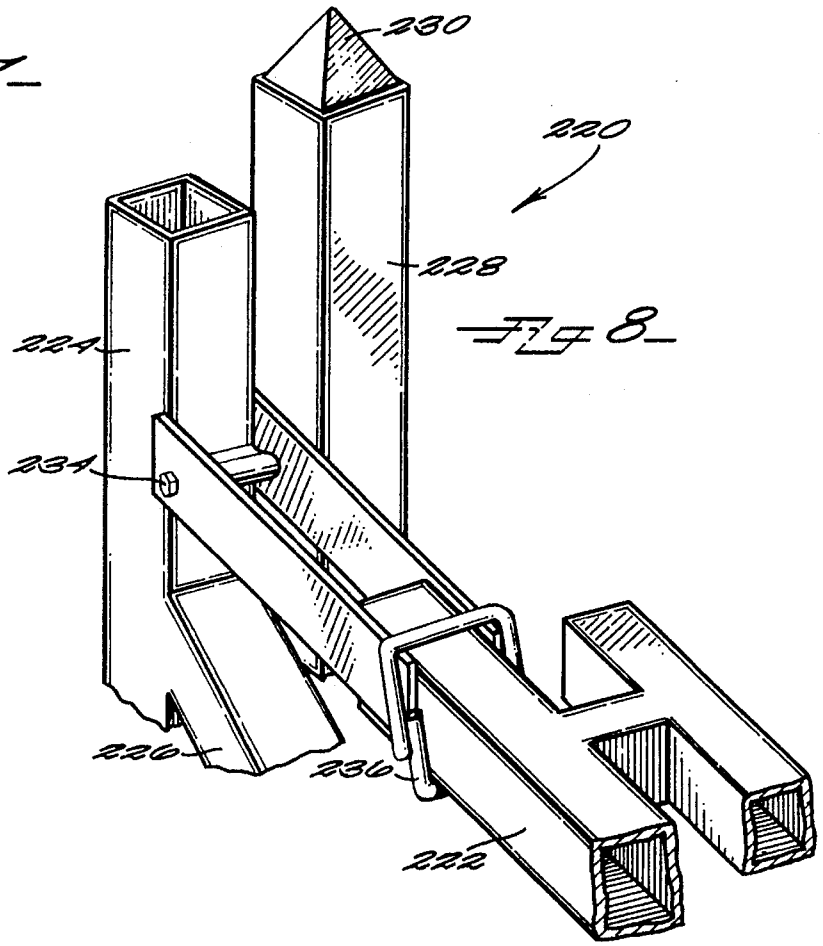
FIG. 8 is a detailed perspective view of the latch of FIG. 7, shown with the side in the storage position.
Figure 7:
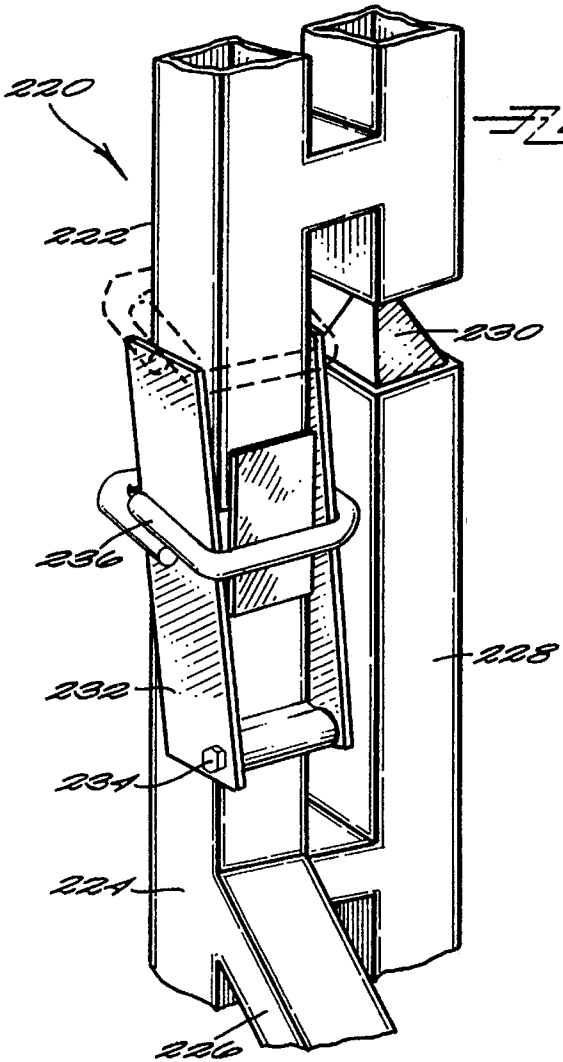
FIG. 7 is a detailed perspective view of a latch for a side of a rack according to a preferred embodiment of the present invention, shown with the side latched in the operative position.

FIGS. 7 and 8 illustrate a preferred embodiment for the pivoting of the sides of a rack. Illustrated in both FIGS. 7 and 8 is a portion of a rack 220 with a portion of a side 222 and a portion of a base 224. Base 224 has a brace 226 for added strength and a post 228 with a point 230. At the bottom of side 222 is a collar 232 pivotally attached to base 224 at pivot pin 234. Collar 232 is preferably welded to side 222. A square ring 236 slides up and down over side 222 and collar 232, sliding down far enough to hold side 222 to base 224 as shown in FIG. 7. When ring 236 is lifted clear of base 224, side 222 can be pivoted about pivot pin 234 to the storage position (FIG. 8) from the operative position (FIG. 7). When in the storage position, it will be clear that point 230 is the highest part of rack 220 and capable of having another rack 220 placed on top of it. Alternatively, a "shoe" made of angle iron flared outward and welded to the top outside corner of base 224 can be used instead of a point to help hold a next rack on a first rack.

Frame material is preferably two inch steel or aluminum tubing. If steel tubing is used, it is preferably hot dip galvanized for prolonged outdoor use.

It will be clear from the foregoing detailed description of preferred embodiments that many substitutions and modifications can be made without departing from the spirit and scope of the invention, which is defined by the appended claims.

What is claimed is:

1. A rack for shipping objects, said rack comprising:

a frame having a first side, a second side, a base, said first side and said second sides being pivotally attached to said base so that said first and second sides can pivot between an operating position and a storage position; and a plurality of clamps carried by said frame, each clamp of said plurality of clamps being pivotable between an operative position and a storage position, said clamps being in said operative position for holding said objects for shipping and being pivotable to said storage position when said object has been removed from said rack.

2. The rack as recited in claim 1, wherein said plurality of clamps are pivotally attached to said first and said second sides.

3. The rack as recited in claim 1, wherein said first and said second sides pivot between an operating position wherein said first and second sides stand in opposition to each other and a storage position wherein said first and said second sides are folded toward said base.

4. The rack as recited in claim 1, further comprising means carried by said base for stacking a second frame on said frame when said first and said second sides are pivoted to said storage position.

5. The rack as recited in claim 1, further comprising means carried by said frame for preventing said each clamp from pivoting past said storage position and said operative position.

6. The rack as recited in claim 1, further comprising a plurality of members, and wherein said plurality of clamps are ganged in sets of clamps, each set of clamps being attached to a member, said member pivotally attached to said frame, said each set of clamps pivoting between said operative and said storage positions with said member.

7. A rack for shipping objects, said rack comprising:

a frame;

a plurality of clamps carried by said frame, each clamp of said plurality of clamps being pivotable between an operative position and a storage position, said clamps being in said operative position for holding said objects for shipping and being pivotable to said storage position when said object has been removed from said rack, each clamp of said plurality of clamps having a base, a backing plate carried by said base, a flapper plate pivotally carried by said base, means for moving said flapper plate toward and away from said backing plate so that said flapper plate can move between a clamped position and a released position; and a plurality of stops carried by said frame for preventing said each clamp from pivoting past said storage position and said operative position, each stop of said plurality of stops located in spaced relation to a clamp of said plurality of clamps.

8. The rack as recited in claim 7, wherein each clamp further comprises a pad carried by said flapper plate.

9. The rack as recited in claim 7, wherein each clamp further comprises a rest carried by said backing plate.

10. The rack as recited in claim 7, wherein said backing plate is curved away from said flapper plate to receive an object therebetween.

11. The rack as recited in claim 7, wherein said backing plate and said flapper plate are offset with respect to said base to receive an object therebetween.

12. The rack as recited in claim 7, wherein said moving means further comprises:

a threaded bolt running through said flapper plate and said backing plate; and a nut threadably received by said bolt, said bolt moving said flapper plate toward and away from said backing plate when turned.

13. The rack as recited in claim 7, wherein said moving means further comprises:

a threaded bolt running through said flapper plate and said backing plate;

a nut threadably received by said bolt, said bolt moving said flapper plate toward and away from said backing plate when turned; and a bolt stop carried by said bolt to prevent said nut from backing off said bolt.

14. A rack for shipping objects, said rack comprising:

a frame having a first side, a second side in spaced relation to said first side, and a base, said first and said second sides being attached to said base; and a plurality of clamps carried by said frame, each clamp of said plurality of clamps having a base, a backing plate carried by said base, a flapper plate pivotally carried by said base, and means for moving said flapper plate toward and away from said backing plate so that said flapper plate can move between a clamped position and a released position.

15. The rack as recited in claim 14, wherein each clamp of said plurality of clamps is pivotable between an operative position and a storage position, said clamps being in said operative position for holding said objects for shipping and being pivotable to said storage position when said object has been removed from said rack.

16. The rack as recited in claim 14, wherein said first side and said second side being pivotally attached to said base so that said first and second sides can pivot between an operating position and a storage position.

17. The rack as recited in claim 15, further comprising a bumper pivotally attached to said frame for spacing said first and said second sides from an adjacent rack, said bumper being pivotable between an operative and a stored position.

18. The rack as recited in claim 1, wherein said plurality of clamps are pivotally attached to said first and said second sides, and wherein said first and said second sides pivot between an operating position wherein said first and second sides stand in opposition to each other and a storage position wherein said first and said second sides are folded toward said base.

19. The rack as recited in claim 1, further comprises:

means carried by said frame for preventing said each clamp from pivoting past said storage position and said operative position; and means carried by said base for stacking a second frame on said frame when said first and said second sides are pivoted to said storage position.

20. The rack as recited in claim 1, further comprising means carried by said base for stacking a second frame on said frame when said first and said second sides are pivoted to said storage position and wherein said plurality of clamps are pivotally attached to said first and said second sides.

* * * * *